US006422192B1

(12) United States Patent
Bloomer

(10) Patent No.: US 6,422,192 B1
(45) Date of Patent: Jul. 23, 2002

(54) EXPANSION RESERVOIR OF VARIABLE VOLUME FOR ENGINE AIR INDUCTION SYSTEM

(75) Inventor: Stephen F. Bloomer, London (CA)

(73) Assignee: Siemens VDO Automotive, Inc., Tilbury (CA)

( * ) Notice: Subject to any disclaimer, the term of this patent is extended or adjusted under 35 U.S.C. 154(b) by 0 days.

(21) Appl. No.: 09/661,770

(22) Filed: Sep. 14, 2000

Related U.S. Application Data

(60) Provisional application No. 60/158,922, filed on Oct. 12, 1999.

(51) Int. Cl.[7] ..... F02M 35/00
(52) U.S. Cl. ..... 123/184.57
(58) Field of Search ..... 123/184.57

(56) References Cited

U.S. PATENT DOCUMENTS

| | | | | | |
|---|---|---|---|---|---|
| 4,538,556 | A | * | 9/1985 | Takeda | 123/184.57 |
| 4,546,733 | A | * | 10/1985 | Fukami et al. | 123/184.57 |
| 5,107,800 | A | * | 4/1992 | Araki et al. | 123/184.57 |
| 5,156,116 | A | * | 10/1992 | Scherenberg | 123/184.57 |
| 5,441,023 | A | * | 8/1995 | Ma | 123/184.57 |
| 6,155,224 | A | * | 12/2000 | Akihisa et al. | 123/184.57 |
| 6,192,850 | B1 | * | 2/2001 | Rutschmann et al. | 123/184.57 |

FOREIGN PATENT DOCUMENTS

| | | | |
|---|---|---|---|
| JP | 58 093929 | A | 6/1983 |
| JP | 60 022021 | A | 2/1985 |
| JP | 04 019314 | A | 1/1992 |
| JP | 04 246220 | A | 9/1992 |
| JP | 10 122072 | A | 5/1998 |

OTHER PUBLICATIONS

PCT International Search Report completed Dec. 18, 2000.

* cited by examiner

*Primary Examiner*—Marguerite McMahon
*Assistant Examiner*—Jason Benton

(57) ABSTRACT

An air resonator system for a vehicle has a variable volume to reduce noise expected at both high and low speeds. In one enbodiment, a pair of necks communicate with chamber portions. A valve selectively blocks communication between the chamber portions and allows each of the necks to communicate with the relatively small volume chamber portions. This position is particularly good for reducing the high frequency noise is expected at high engine speeds. The valve is movable to a second position at which it allows communication between the two chamber portions and blocks communication between one of the necks and its respective chamber portion. The relatively large chamber volume provided at this position is particularly well suited for reducing the low frequency noise expected with low engine speed. Thus, a single air resonator system is provided which can be adjusted to accommodate noise at both high and low speeds.

20 Claims, 3 Drawing Sheets

EXPANSION RESERVOIR OF VARIABLE VOLUME FOR ENGINE AIR INDUCTION SYSTEM

This application claims priority to provisional application 60/158,922 filed Oct. 12, 1999.

BACKGROUND OF THE INVENTION

This application relates to an air induction system for an engine having an expansion reservoir to cancel noise wherein the volume of the reservoir may be varied to accommodate different engine conditions.

Modern engines for vehicles are the subject of a good deal of engineering. One feature that modem engineers attempt to address is the reduction of induction noise by providing a resonant chamber adjacent an air intake system leading to the engine. As is known, as air is induced into the engine, noise comes from the engine outwardly through the air inlet lines. Known resonators are finely tuned to cancel this noise. However, the noise varies between high and low engine speeds. Typically, the design of these resonators has been a compromise to achieve a single volume which addresses neither the highest or lowest speeds as optimally as would be desired.

Typically, the resonators include an air reservoir of a fixed volume connected through a neck to an air flow line leading to an engine. The fixed volume is finally designed to address a certain type of engine noise. However, the engine noise will vary between high and low speeds, and thus this volume is typically not optimally designed for either speed.

SUMMARY OF THE INVENTION

In the disclosed embodiment of this invention, a resonator chamber system provides variable volumes, and may be switched between at least two modes at high and low engine speeds to provide an optimized noise reduction for each speed. In this regard, the chamber volumes can be designed to provide Helmholtz resonators with a desired volume for each of high and low engine speeds.

In one embodiment, a pair of necks connect to a volume of a resonator body. The preferred embodiment of this invention has a moving flap that can selectively communicate or separate two volumes to provide finely tuned chamber volumes. Seal surfaces are provided on opposed faces of the flap valve. A stop surface is formed within an inner body of the resonator chamber housing.

A pivot point is preferably positioned adjacent an upper wall of the body. Linkages pivotally attach to the pivot linkage, outwardly of the body. The linkage is connected to an actuator which is connected to an engine control. The engine control actuates the in response to variations in engine speed.

The flap valve is movable between a first position at which it closes the second neck, and thus communicates the two chambers together to provide a large volume chamber. This is particularly valuable at low speeds wherein there is a lower frequency which is to be reduced. The engine control will move the actuator, and thus the flap valves to communicate the chambers at lower speeds. However, as the engine is moved to higher speeds, the flap valve is moved to a position at which is isolates the two chambers. Thus, the two necks communicate with separate chambers. This configuration is better suited to eliminate and reduce noise associated with higher frequency and engine speeds. Again, the engine control is operable to move the flap valve as necessary.

In other embodiments, the flap valve moves to direct the flow of air to the engine through one of two passages. The other passage then becomes the resonant chamber. The two passages have different volumes and shapes, and thus the two different passages can be designed to create the tuned configuration most optimum for the two engine conditions.

These and other features of the present invention can be best understood from the following specification and drawings, the following of which is a brief description.

DETAILED DESCRIPTION OF A PREFERRED EMBODIMENT

Figure 1A:
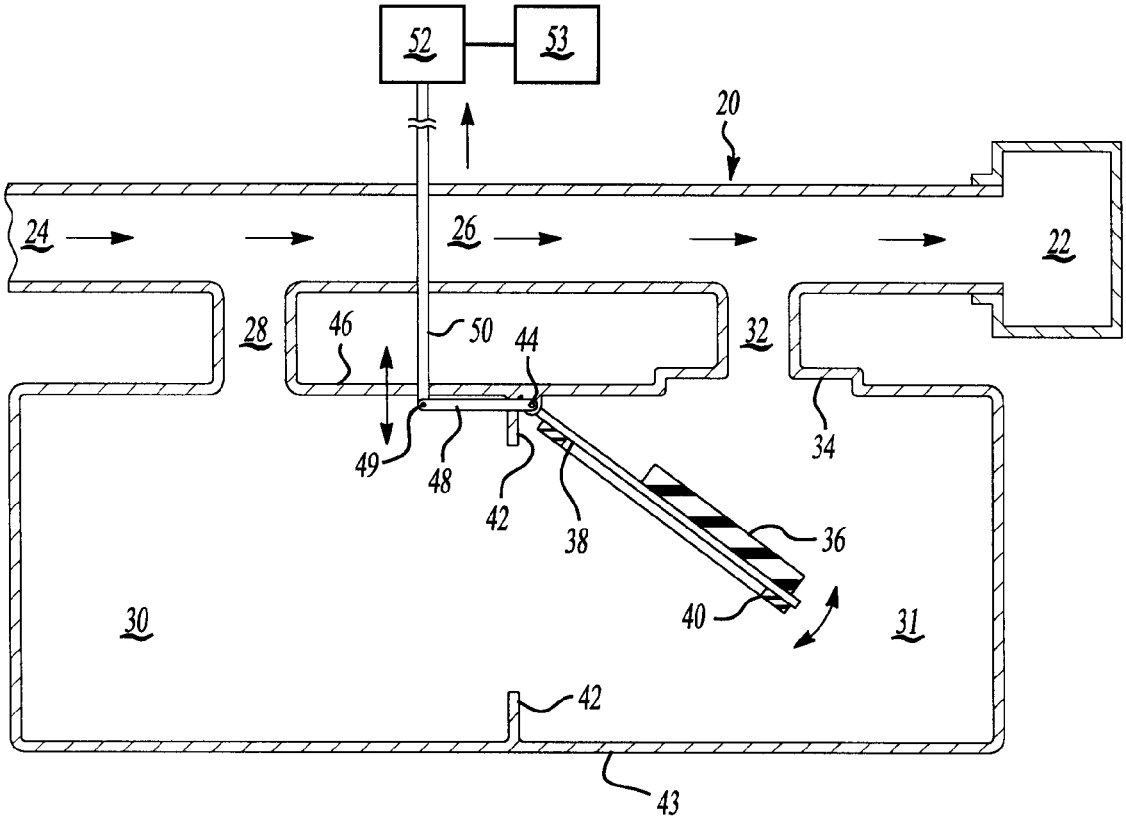
FIG. 1A schematically shows an intermediate position of the inventive valve.

FIG. 1A shows a system 20 for providing air to and reducing noise from, an engine 22. Air from a source 24 flows through a tube 26 to the engine 22. A first neck 28 communicates with a resonator volume 30 and a second neck 32 selectively communicates with a volume 31. Second neck 32 is provided with a sealing surface 34 for selectively being sealed by a seal 36 on a flap valve 38. A second sealed surface 40 is selectively moved into contact with a sealing lip 42 extending inwardly from the resonator body 43. A pivot point 44 is positioned just beneath an upper wall 46 of the resonator body 43. A first linkage 48 is pivotally connected at 49 to a second linkage 50.

Figure 1B:
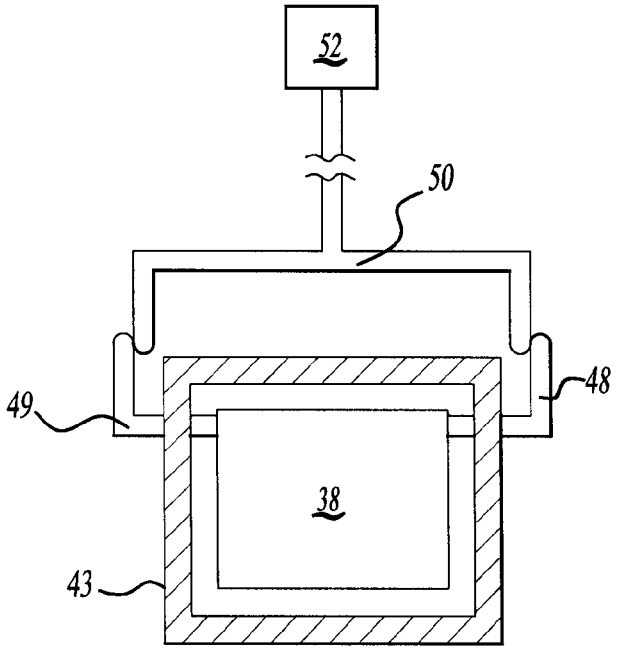
FIG. 1B schematically shows the actuation mechanism for the inventive valve.

As can be appreciated from FIG. 1B, the linkages 48 and 50 and the pivot points 44 are positioned outwardly of the resonator body 43. The linkage 50 is communicated to an actuator 52, which may be a fluid actuator, such as a pneumatic actuator. The actuator pulls the linkage 50 upwardly or pushes it downwardly to cause the linkage 48 to pivot at point 44, and cause movement of the flap valve 38. An engine control 53 selectively controls the actuator.

Figure 2:
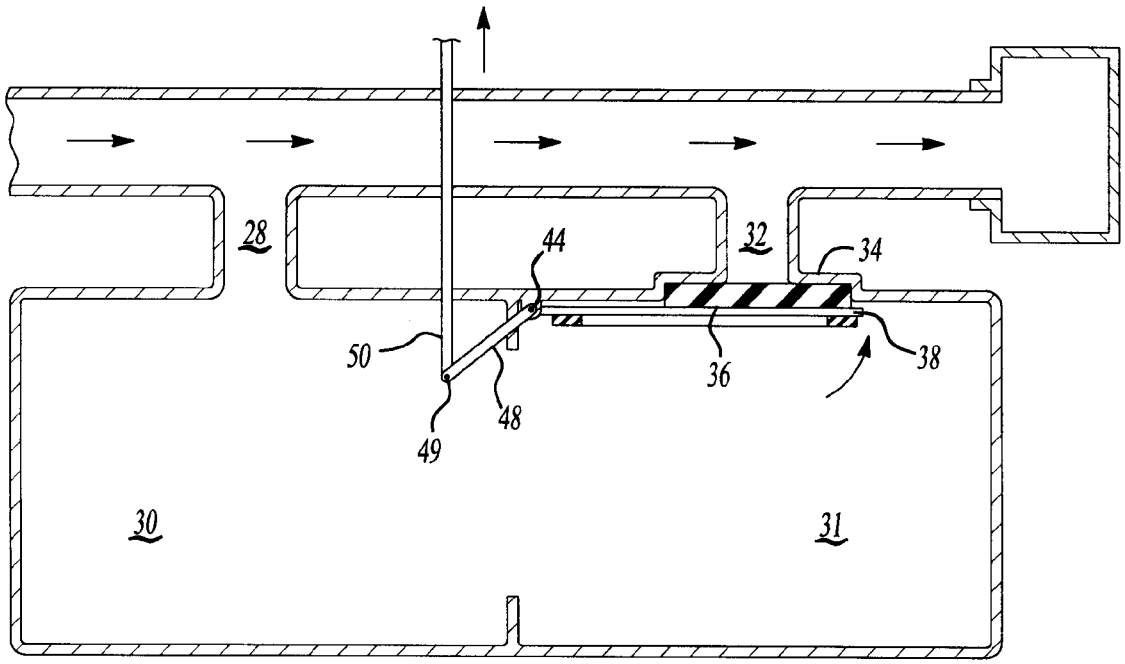
FIG. 2 shows the valve in a first low speed position.

As shown in FIG. 2, the flap valve 38 has been moved to a position at which the seal 36 seats on seat 34. As can be appreciated, the linkage 50 has been driven downwardly, and the linkage 48 has thus forced the flap valve to the position illustrated in this figure. It should be appreciated that some seal between the linkage 48 and pivot point 44 would be desirable provided. In the embodiment illustrated the connection between linkage 48 and the flap valve 38 is rigid such that the two move as one.

By sealing the connection between linkage 48 and the point 44, an air tight seal is provided within the chambers 30 and 31. In the position shown in FIG. 2, the chambers 30 and 31 communicate to form one very large chamber. The very large chamber is particularly adapted to reduce low frequency noise such as is experienced by an engine traveling at low speed. Thus, at low engine speeds the control 53 will move the linkage 50 to the FIG. 2 position to communicate the chamber 30 and 31.

Figure 3:
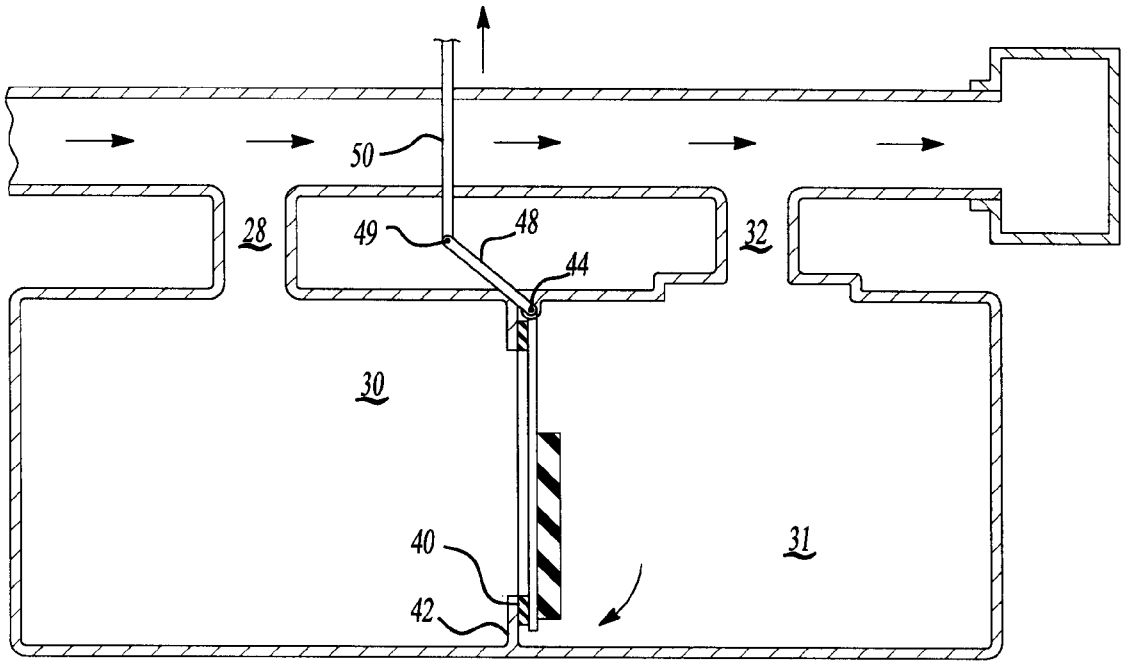
FIG. 3 shows the resonator system in a position for higher engine speed.

As the engine approaches higher speeds, the linkage 50 is moved as shown in FIG. 3 to a position at which the seal 40 seats against the surface 42. In this position, the chambers 30 and 31 are separated. Each of the two chambers thus provide small volume resonator chambers. These chambers are particularly tuned for reducing the noise at higher frequency such as experienced at higher engine speed. Again, this simple control allows the resonator chamber system to be tuned to a particular speed of the engine.

Figure 4:
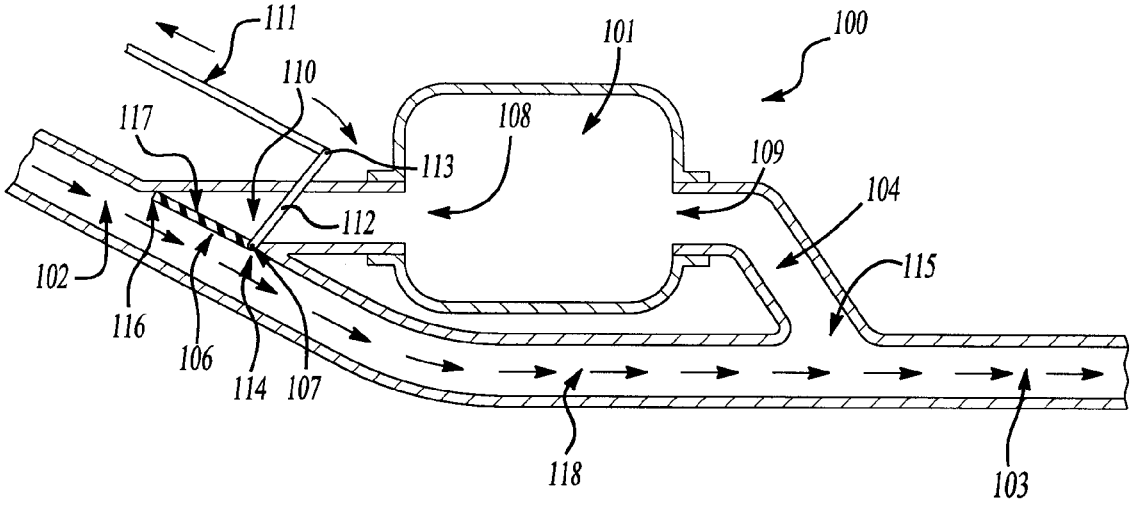
FIG. 4 shows another embodiment of the invention.

FIG. 4 shows another embodiment 100 wherein a main supply passage 102 passes air through a passage 118 to a connection 103 to the engine. A pair of necks 114 and 104 selectively communicate an enlarged plenum 101 to the passage 118. The connection can be through the neck opening 115, or through the neck opening 106. As shown, the plenum 101 connects through a passage 110 through an opening 108, and connects to the passage 104 through the opening 109. The flap valve 117 is selectively actuated by actuation structure 110 through a link 111 and a second link 112, which are pivotally connected at 113. The link 112 is fixed at 107 to the flap valve 117. The flap valve 117 seats at the outer periphery 116 of the opening 106.

In the position shown in FIG. 4, the flap valve is moved to close the passage 106, and thus the flow of air to the engine passes through the passage 118. The opening 115 becomes a neck communicating with a relatively large chamber 101 to provide the noise reduction as described above.

Figure 5:
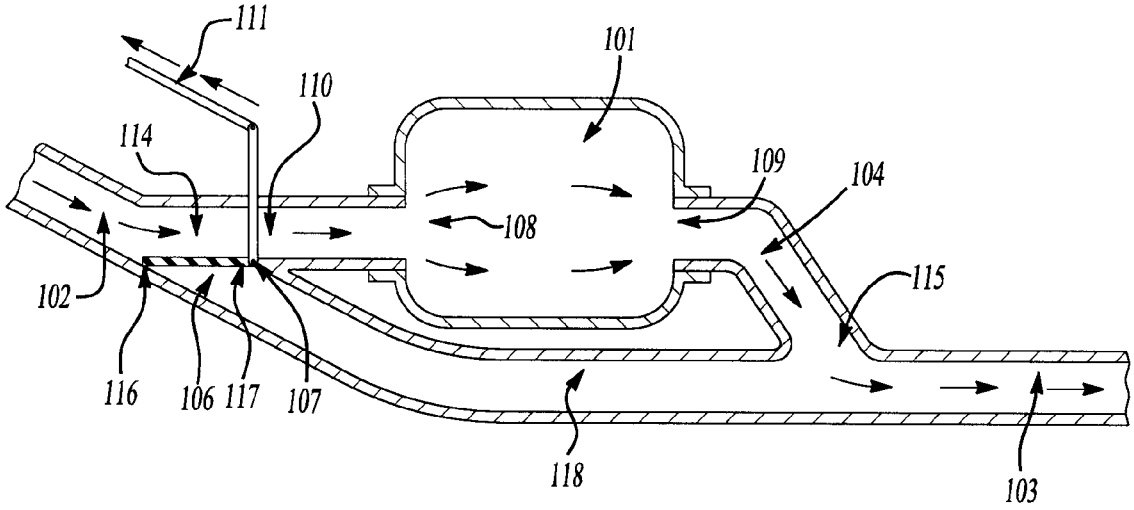
FIG. 5 shows the FIG. 4 embodiment in a second position.

The flap valve 117 is movable to the position such as shown in FIG. 5 at which it blocks flow into the passage 118, and instead directs air flow through the chambers 101. In this embodiment, the passage 118 becomes the resonant chamber. As mentioned above, a worker in this art would be able to design a control which provided with feedback from the engine, would be able to select one of the two configures for optimum noise reduction for any engine speed.

Figure 6:
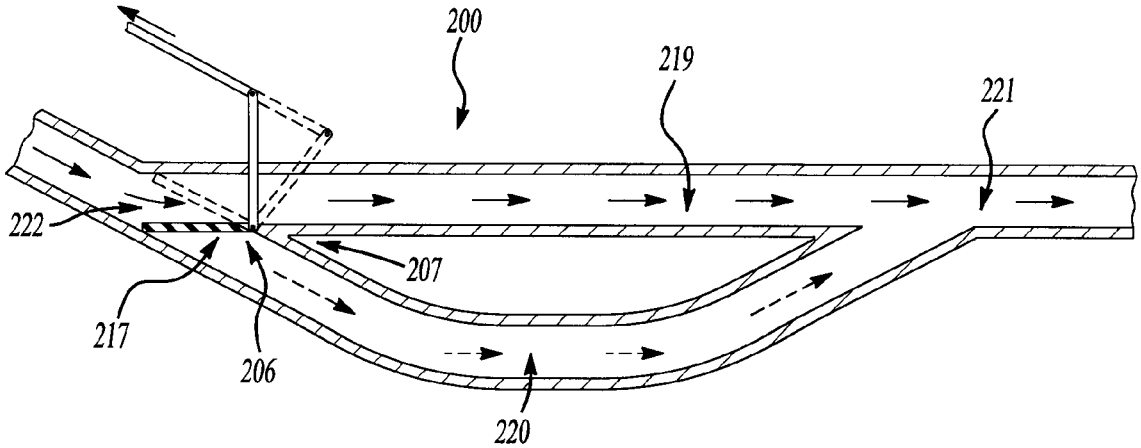
FIG. 6 shows yet another embodiment.

FIG. 6 shows yet another embodiment 200. In embodiment 200, the enlarged volume 101 is eliminated. The flap valve 217 is movable to one of two positions about a pivot point 207. In the position shown in FIG. 6 in solid line, a passage 220 becomes the resonant chamber, and air flows through the passage 219 to the connection 221 to the engine. When the valve 217 is moved to the position shown in phantom, then the air flow passes through the passage 220, and the passage 219 becomes the resonant chamber. Again, a worker in this art would be able to fine-tune the shape and volume of the passages 219 and 220 to achieve desired noise reduction.

Preferred embodiments of this invention have been disclosed, however, a worker in this art would recognize that certain modifications would come within the scope of this invention. For that reason the following claims should be studied to determine the true scope and content of this invention.

What is claimed is:

1. A air intake system for a vehicle engine comprising:

an air connection for connecting to an air supply;

an air tube leading from said air supply to an engine;

a neck connecting said air tube to a body defining a chamber, said chamber having a variable volume; and a valve being movable for varying the volume of said chamber, said valve being selectively moved between a first and second position to vary said chamber volume dependent on the speed of the engine connected to said air supply system.

2. A system as set forth in claim 1, wherein there are a pair of necks communicating with separate areas within said body, said pair of necks communicating with separate chambers, said separate chambers being selectively communicated to each other, with at least one of said necks being blocked to provide a single higher chamber volume, and said two necks each communicating with one of said two chambers and said two chambers being isolated from each other to provide a pair of lower volume chambers.

3. A system as set forth in claim 2, wherein said valve is movable within said resonator body between a first and second position, said valve blocking communication between said two chambers at a first position, and blocking communication between one of said necks and said chambers in a second position.

4. A system as set forth in claim 3, wherein a linkage structure is positioned outwardly of said body to drive said valve.

5. A system as set forth in claim 4, wherein said linkage communicates with a fluid driven actuator.

6. A system as set forth in claim 5, wherein said fluid driven actuator communicates with a control for the engine, the control for the engine driving said valve between the two positions.

7. A system as set forth in claim 4, wherein said valve has seal surfaces on both of a first and second face, said seal surfaces selectively sealing off said at least one neck or selectively blocking communication between said first and second chambers.

8. A system as set forth in claim 7, wherein a resonator body has an inwardly extending lip, and said seal sealing on said lip when said valve is in a position blocking communications between said two chambers.

9. A system as set forth in claim 1, wherein said valve includes a flap valve movable to selectively block flow into one of two passages, with air flowing through the other of the two passages to the engine, and said flap valve being controlled to achieve a desired chamber volume based upon the selected position of said flap valve.

10. A system as set forth in claim 9, wherein said two passages communicate with each other at an upstream location adjacent to said flap valve and at a downstream location such that the passages which does not receive air flow to the engine provides a neck for communicating with the resonant chamber.

11. A system as set forth in claim 10, wherein one of said two passages has an enlarged volume plenum.

12. A method of providing variable noise reduction dependent on operation of a vehicle engine comprising the steps of:

1) providing an air flow system leading to an engine, and providing an air resonator system in said air flow system, said air resonator system including at least one neck communicating with a variable volume chamber, and providing a valve for varying the volume of said chamber; and 2) varying the volume of said chamber dependent on engine speed by moving said valve.

13. A method as set forth in claim 12, wherein there are a pair of said necks each communicating with separate chamber portions, and a valve is moved to selectively block one of said necks from its chamber portion, and to communicate the two chamber portions at low engine speeds and moved for blocking communication between the two chamber portions when the engine is driven at a higher speed.

14. A method as set forth in claim 12, wherein there are a pair of passages selectively leading to said engine, said pair of passages communicating at both an upstream and a downstream location, and said valve including a flap valve selectively directing flow through one of said two passages at said upstream location, said flap valve being moved to a desired position to direct flow through a desired one of said two passages based upon engine speed.

15. An engine for a vehicle comprising:

an engine including an air supply including a pipe leading to a source of air, for supplying air to said engine;

an air resonator noise reduction system communicating with said pipe, said air resonator system including at least a plurality of necks each communicating with chamber portions; and a valve movable within said resonator body, said valve selectively allowing communication between said at least a pair of necks with each of said chamber portions and blocking communication between said chamber portions in a first position and being movable to a second position at which it blocks communication between at least one of said necks and its respective chamber portion and allows communication between said chamber portions, and structure for driving said valve between said first and second positions.

16. An engine for a vehicle comprising:

an engine including an air supply including a pipe leading to a source of air for supplying air to said engine;

an air resonation noise reduction system communicating with said pipe, said air resonator system including a pair of passages communicating with each other at an upstream and at a downstream location, and being the intermediate said air supply in said engine; and a valve movable adjacent said upstream connection portion of said two passages, said valve selectively blocking flow from said air supply into one of said two passages such that air will flow through the other of said two passages and to said engine, and said one of two passages thus providing a resonant chamber, said two passages providing resonant chambers of differing volume, and said valve being controlled to select a desired resonant chamber volume.

17. An engine as set forth in claim 16, wherein said one of said two passages has an enlarged plenum volume.

18. A system as set forth in claim 1, wherein a single neck connects said air tube to said chamber in both said first and second positions.

19. A system as set forth in claim 18, wherein said single neck is provided by a distinct neck which communicates said chamber to said air flow system in each of two positions of said valve.

20. A method as set forth in claim 12, wherein a single neck is provided to communicate said variable volume chamber to said air flow system, with said single neck by a distinct neck communicating said chamber to said air flow system in each of two positions as said valve is moved.

* * * * *